US006948350B2

(12) United States Patent
Ono et al.

(10) Patent No.: US 6,948,350 B2
(45) Date of Patent: Sep. 27, 2005

(54) WAVE-PROCESSING METHOD AND WAVE-PROCESSING DIE FOR CORE METAL OF WET FRICTION MATERIAL

(75) Inventors: Hideo Ono, Aichi-ken (JP); Hideto Nakagawa, Aichi-ken (JP); Katsuhiro Yamamoto, Higashimatsuyama (JP)

(73) Assignees: Aisin Kako Kabushiki Kaisha, Nishikamo-gun (JP); Yamamoto Seisakusho Co., Ltd., Higashimatsuyama (JP)

( * ) Notice: Subject to any disclaimer, the term of this patent is extended or adjusted under 35 U.S.C. 154(b) by 90 days.

(21) Appl. No.: 10/736,980

(22) Filed: Dec. 17, 2003

(65) Prior Publication Data

US 2005/0061407 A1 Mar. 24, 2005

(30) Foreign Application Priority Data

May 19, 2003 (JP) ..... 2003-140758

(51) Int. Cl.[7] ..... B21D 28/00

(52) U.S. Cl. ..... 72/329; 72/334; 72/335; 72/379.6; 72/414; 29/896.9

(58) Field of Search ..... 72/329, 334, 335, 72/414, 385, 379.6; 29/896.9

(56) References Cited

U.S. PATENT DOCUMENTS

| | | | | | |
|---|---|---|---|---|---|
| 3,377,828 | A | * | 4/1968 | Harmon | 72/2 |
| 3,748,888 | A | * | 7/1973 | Gerich | 72/375 |
| 4,126,216 | A | * | 11/1978 | Babcock et al. | 192/89.25 |
| 4,829,799 | A | * | 5/1989 | Coe et al. | 72/47 |
| 4,865,603 | A | * | 9/1989 | Noiles | 623/23.5 |
| 5,794,484 | A | * | 8/1998 | Jaddou | 72/414 |

* cited by examiner

*Primary Examiner*—Daniel C. Crane
(74) *Attorney, Agent, or Firm*—Westerman, Hattori, Daniels & Adrian, LLP

(57) ABSTRACT

A ring-shaped core metal is pressed and compressed by a main punch and a counter punch so as to have a wave shape. Moreover, each group of three micro-protrusions provided on each of top points of the wave shape are cut in the core metal. Then, three notches are cut on the core metal corresponding to the micro-protrusions. Furthermore, plastic flow is generated at a surface layer of the core metal due to partial compression by the notches at the time of pressing and compressing. Then, the waves are formed on the core metal with the notches as the top points. The notches are cut at seven sections respectively on a front surface and a rear surface of the core metal. Thus, seven waves are formed on the core metal in total. Since the notches are formed on the front and the rear surfaces of the waves, a "return" phenomenon is not generated as seen in a conventional cool working method. Thus, the waves are formed at high accuracy.

10 Claims, 9 Drawing Sheets

WAVE-PROCESSING METHOD AND WAVE-PROCESSING DIE FOR CORE METAL OF WET FRICTION MATERIAL

BACKGROUND OF THE INVENTION

1. Field of the Invention

This invention relates to a wave-processing method and a wave-processing die for a core metal of a wet friction material, which gains torque by applying high pressure to an opposite face while dipped in an oil and which is made by joining a friction material substrate to a ring core metal by adhesion.

2. Description of the Related Art

A technique has been developed for waving or undulating a core metal plate of a wet friction material so as to absorb shock in engaging a friction material with an opposite face of a pressure plate. This enables the clutch to smoothly engage. With such technique, the ring-shaped core metal is given a wave shape or undulation in its circumferential direction. Thus, a wave or undulation is provided on a face of a wet friction material that is stuck to the core metal. Specifically, there are two main methods of giving the wave to the core metal of the wet friction material. These conventional methods are described referring to FIG. 14 and FIG. 15. FIG. 14 is a schematic view showing a conventional cool working process. FIG. 15 is a schematic view showing a conventional hot working process.

The cool work process is described referring to FIG. 14. As shown in FIG. 14, in the cool working process, a core metal 53 made by stamping is kept pressed between a punch 51 and a counter punch 52 of a die 50 having a wave shape. Thus, the wave shape of the die 50 is transferred or imparted to the core metal 53. This method is relatively simple and has good productivity. However, a wave height given to the die 50 cannot be imparted to the core metal as it is, due to "return" phenomenon after releasing pressure. Therefore, in general, it is necessary to form the wave shape of the die 50 at a height several times to several dozens times as large as a required wave height. Moreover, the "return" of a core metal steel must be taken into account.

On the other hand, in the hot working process, as shown in FIG. 15, a plurality of core metals 58 are stacked in layers. Then, the core metals 58 are heated at a high temperature of 400 to 500 degrees centigrade while pressed between an upper mold 56 and a lower mold 57 of a die 55 having a wave shape. Thus, it restrains the "return" of the core metal steel. With the hot working process, the wave shape 58*a* can be obtained stably, since the wave shape is imparted to the core metal 58 while relieving and removing internal stress of the core metal 58 by heating.

In the cool working process shown in FIG. 14, there take place very different "return" phenomenon on the core metal steel depending on various factors. Particularly, it depends very much on a history of the steel material. Specifically, it is difficult to satisfy a stable wave height even if the core metal is pressed by the same wave-processing die 50, depending on factors such as a steel material lot, rolling history, rolling direction, etc. Thus, there is much variation in the waves 53*a* formed by the cool working process. Consequently, the cool working process cannot satisfy wave accuracy required for the wet friction material.

On the other hand, in the hot working process show in FIG. 15, high wave accuracy can be stably obtained. Therefore, the hot working process is adopted as the waving process these days. However, the hot working process has complicated steps as compared with the cool working process. Moreover, the hot working process needs longer processing time and is inferior in productivity. Furthermore, with the hot working process, the core metal must be processed at a high temperature. Then, it has disadvantages that huge amount of energy is consumed and that production costs increase inherently.

BRIEF SUMMARY OF THE INVENTION

An object of the present invention is to provide a wave-processing method and a wave-processing die of a core metal of a wet friction material that stably achieves a high accuracy of wave shape with a simple process, in a short processing time and at low costs.

According to a first aspect of the invention, there is provided a wave-processing method for a core metal of a wet friction material comprising the steps of stamping out a material steel sheet so as to form a core metal blank having a shape corresponding to a shape of the core metal by a stamping die, and giving a wave shape to the core metal blank in a circumferential direction thereof by a special die at the same time as or after the stamping step. The special die has a main punch as an upper die and a counter punch as a lower die. The main punch and the counter punch have compression faces respectively formed with the wave shape while having a micro-protrusion at a portion corresponding to a top point of the wave shape. The core metal blank is compressed between the main punch and the counter punch so that the micro-protrusion is cut into the core metal blank so as to form a notch on the core metal blank.

According to a second aspect of the invention, there is provided a wave-processing method for a core metal of a wet friction material comprising the following steps. A material steel sheet is compressed by a die having micro-protrusions on an entire surface so as to form notches of a net shape composed of many curves at a front surface and a rear surface of a portion to be the core metal of the material steel sheet, thereby correcting a flatness of the material steel sheet at the portion. Then, the material steel sheet is stamped out after the compressing step so as to form a core metal blank having a shape corresponding to a shape of the core metal by a stamping die. Then, a wave shape is given to the core metal blank in a circumferential direction thereof by a special die at the same time as or after the stamping step. The special die has a main punch and a counter punch. The main punch and the counter punch have compression faces respectively formed with the wave shape. The core metal blank is compressed between the main punch and the counter punch.

According to a third aspect of the invention, there is provided a wave-processing die for a core metal of a wet friction material for stamping out a material steel sheet so as to form a core metal blank having a shape corresponding to a shape of the core metal, and giving a wave shape to the core metal blank in a circumferential direction thereof at the same time as or after stamping. The wave-processing die comprises: a main punch having a compression face; and a counter punch having a compression face oppositely disposed to the compression face of the main punch. The compression faces of the main punch and the counter punch are respectively formed with the wave shape while having a micro-protrusion at a portion corresponding to a top point of the wave shape. The core metal blank is compressed between the main punch and the counter punch so that the micro-protrusion is cut into the core metal blank so as to form a notch on the core metal blank.

In the wave-processing die for a core metal of a wet friction material, the micro-protrusion may have a height of about 1% to 5% of a thickness of the core metal and a width of about 50 μm to 500 μm.

In the wave-processing die for a core metal of a wet friction material, the micro-protrusion may have a shape composed of a plurality of first lines extending straightly in a radial direction of the core and a plurality of second lines extending straightly or curvedly substantially in a circumferential direction of the core metal while crossing the first lines.

In the wave-processing die for a core metal of a wet friction material, the micro-protrusion may have a shape composed of an aggregate of dots having a pyramid-shape.

In the wave-processing die for a core metal of a wet friction, the micro-protrusion may have a cross-section of a wedge and the micro-protrusion of the main punch may be shifted in position from the micro-protrusion of the counter punch in a circumferential direction of the core metal.

In the wave-processing die for a core metal of a wet friction material, the micro-protrusion may have a shape of a broken line.

In the wave-processing die for a core metal of a wet friction, the micro-protrusion may have a length such that opposite ends of the notch formed on the core metal by the micro-protrusion are positioned 0.2 mm or more away from outer and inner circumferences of the core metal.

According to a fourth aspect of the invention, there is provided a wave-processing die for a core metal of a wet friction material. The wave-processing die comprises a first processing die and a second processing die. The first processing die stamps out a material steel sheet so as to form a core metal blank having a shape corresponding to a shape of the core metal and gives a wave shape to the core metal blank in a circumferential direction thereof at the same time as or after stamping. The first processing die has a main punch and a counter punch respectively having compression faces disposed opposite to each other and being respectively formed with the wave shape. A second processing die corrects a flatness of the material steel sheet. The second processing die has a main punch and a counter punch respectively having compression faces disposed opposite to each other and being respectively formed with micro-protrusions for forming a net shape composed of many curves. The core metal blank is compressed between the main punch and the counter punch of the first processing die so as to give the wave shape to the core metal blank after the material steel sheet is compressed between the main punch and the counter punch of the second processing die so that the micro-protrusions are cut into the core metal blank so as to form notches of the net shape composed of the many curves on the core metal blank.

Further objects and advantages of the invention will be apparent from the following description, reference being had to the accompanying drawings, wherein preferred embodiments of the invention are clearly shown.

DETAILED DESCRIPTION OF THE INVENTION

Figure 1A:
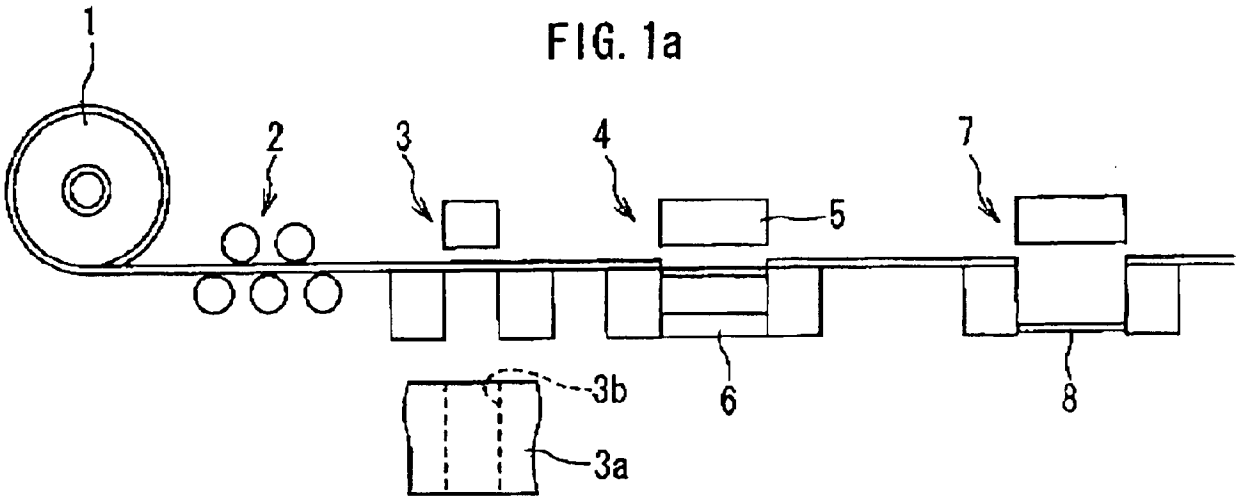
FIG. 1*a* is a schematic view showing all steps of a wave-processing method of a core metal of a wet friction material according to a first embodiment of the invention wherein a material steel plate is stamped out at an inner circumferential edge of a core metal and further stamped at an outer circumferential edge of the core metal while waving the core metal.

Several embodiments of the invention are described hereunder referring to the attached drawings. The same reference character is used to show the same element throughout the several embodiments.

First Embodiment

{Overall Structure}

Figure 1B:
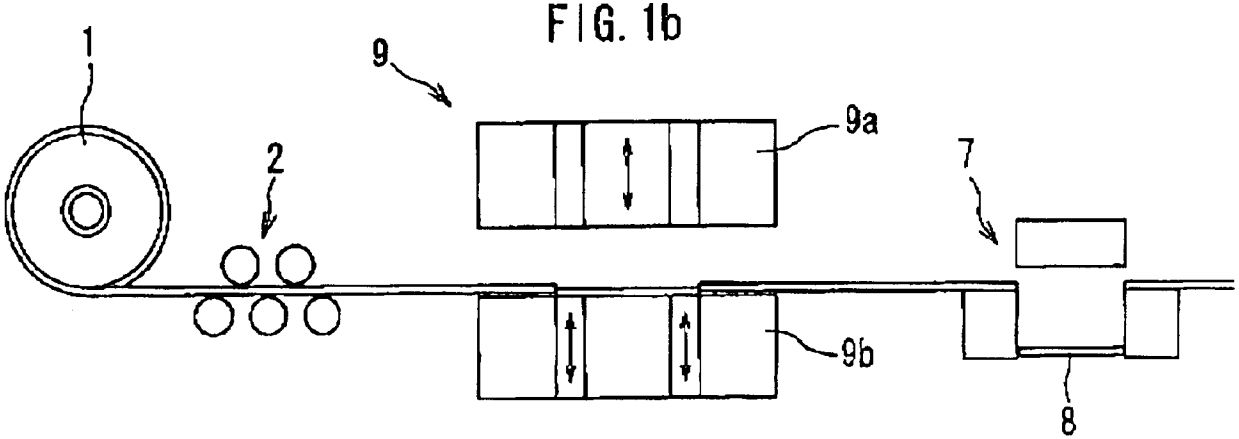
FIG. 1*b* is a schematic view showing all steps of a wave-processing method of a core metal of a wet friction material according to a first embodiment of the invention wherein a material steel plate is stamped at an inner and an outer circumferential edges of a core metal at once while waving the core metal.
Figure 2A:
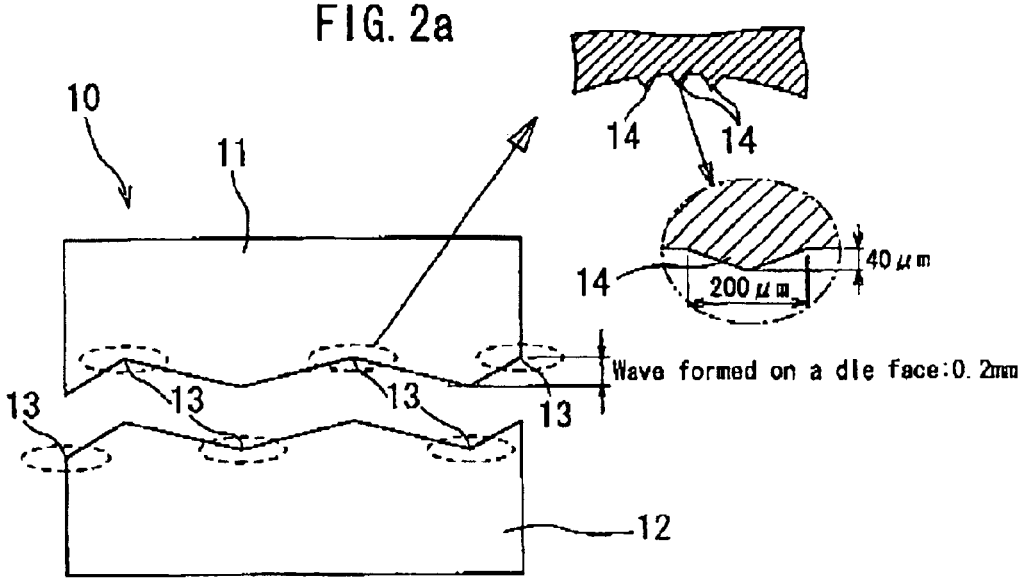
FIG. 2*a* is a schematic view showing a main punch and a counter punch of a wave-processing die used in the wave-processing method of the core metal of the wet friction material according to the first embodiment of the invention while illustrating micro-protrusions in an enlarged manner.
Figure 2B:
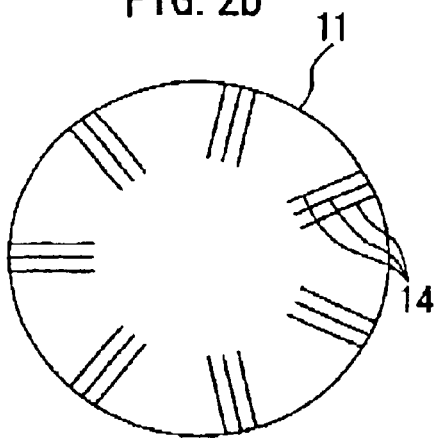
FIG. 2*b* is a bottom view showing a position and a shape of the micro-protrusion formed on a lower surface of the main punch.
Figure 2C:
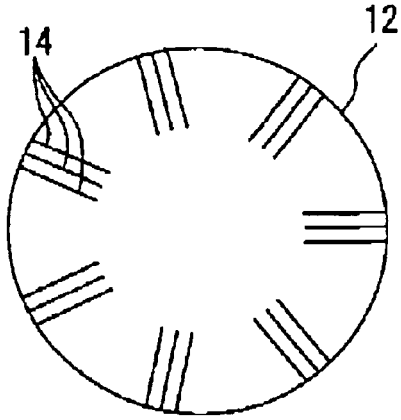
FIG. 2*c* is a plan view showing a position and a shape of the micro-protrusion formed on an upper surface of the counter punch.
Figure 3A:
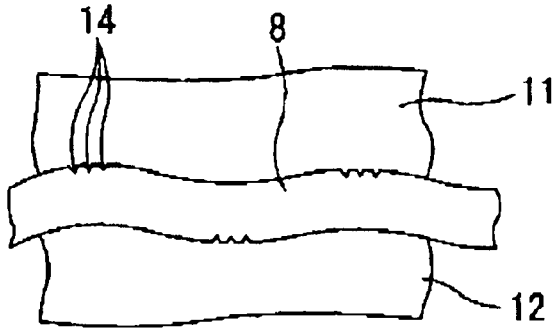
FIG. 3*a* is a partial side view showing a state of the core metal pressed and compressed between the main punch and the counter punch in the wave-processing method of the core metal of the wet friction material according to the first embodiment of the invention.
Figure 3B:
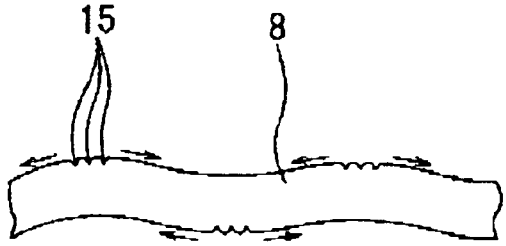
FIG. 3*b* is a partial side view showing the core metal on surfaces of which notches were cut as a result of FIG. 3*a* and plastic flow is generated accordingly.
Figure 3C:
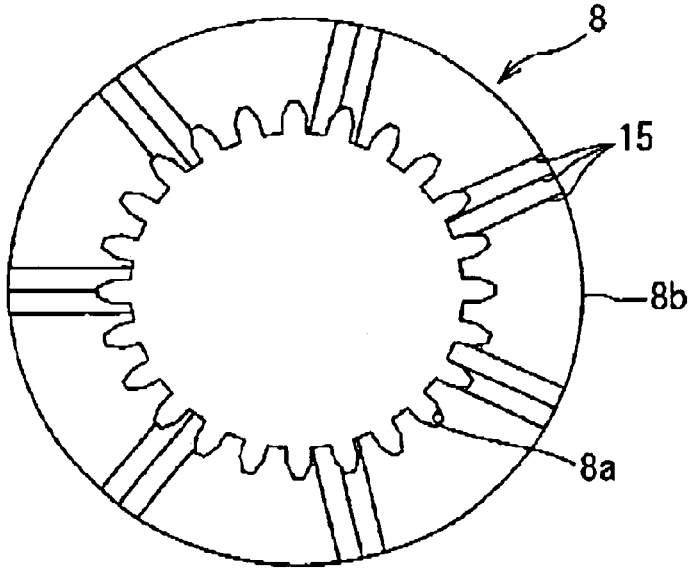
FIG. 3*c* is a plan view showing the core metal in its entirety that has the notches cut and waves formed. showing a waved core metal manufactured by a wave-processing method and a wave-processing die of a core metal of a wet friction material according to a second embodiment of the invention.

A first embodiment of the invention is described referring to FIG. 1 to FIG. 3. FIG. 1*a* is a schematic view showing all steps of a wave-processing method of a core metal of a wet friction material according to a first embodiment of the invention wherein a material steel plate is stamped out at an inner circumferential edge of a core metal and further stamped at an outer circumferential edge of the core metal while waving the core metal. FIG. 1*b* is a schematic view showing all steps of a wave-processing method of a core metal of a wet friction material according to a first embodiment of the invention wherein a material steel plate is stamped at an inner and an outer circumferential edges of a core metal at once while waving the core metal. FIG. 2*a* is a schematic view showing a main punch and a counter punch of a wave-processing die used in the wave-processing method of the core metal of the wet friction material according to the first embodiment of the invention while illustrating micro-protrusions in an enlarged manner. FIG. 2*b* is a bottom view showing a position and a shape of the micro-protrusion formed on a lower surface of the main punch. FIG. 2*c* is a plan view showing a position and a shape of the micro-protrusion formed on an upper surface of the counter punch. FIG. 3*a* is a partial side view showing a state of the core metal pressed and compressed between the main punch and the counter punch in the wave-processing method of the core metal of the wet friction material according to the first embodiment of the invention. FIG. 3*b* is a partial side view showing the core metal on surfaces of which notches were cut as a result of FIG. 3*a* and plastic flow is generated accordingly. FIG. 3*c* is a plan view showing the core metal in its entirety that has the notches cut and waves formed.

Referring to FIG. 1*a* and FIG. 1*b*, described are overall steps of a wave-processing method of a core metal of a wet friction material according to the first embodiment. First described referring to FIG. 1*a* is a wave-processing method in which a steel material is die-cut in advance only along an inner circumferential edge of a core metal. As shown in FIG. 1*a*, a raw material steel coil or steel plate 1 wound in a coil shape is drawn out into a plain shape and kept in a flat and horizontal state by a precision leveler 2. Next, an inner-circumference cutting-die 3 stamps out the steel plate 1 along the inner circumference of the core metal. At this time, there is obtained a processed raw material steel plate 3*a* that has a through hole 3*b* opened corresponding to the inner circumference of the core metal. Next, a wave-processing die 4 stamps out the steel plate 3*a* along an outer circumference of the core metal, while a main punch 5 and a counter punch 6 compress the steel plate 3*a* to form a waved core metal 8. Then, a push-out device 7 pushes out the waved core metal 8 downward. Thus, the waved core metal 8 is completely manufactured.

Next described referring to FIG. 1*b* is a wave-processing method in which the steel material is stamped out along both the inner and the outer circumferential edges of the core metal and waved at the same time. In the same manner as FIG. 1*a*, the steel coil 1 is drawn out in a plain shape and kept flat and horizontal by the precision leveler 2. Then, a main punch 9*a* and a counter punch 9*b* of a wave-processing die 9 stamp out the steel coil 1 along the inner and the outer circumferences of the core metal at once. At the same time, the main punch 9*a* and the counter punch 9*b* compress the core metal to form the waved core metal 8. Then, the push-out device 7 pushes out the waved core metal 8 downward. Thus, the waved core metal 8 is completely manufactured just by one step.

As described above, with both the methods of FIG. 1*a* and FIG. 1*b*, the waved core metal of the wet friction material can be manufactured in a very few number of steps and with a very short period of time. Alternatively, there is a still another method in which a stamping-out die stamps out the steel plate into a ring-shaped core metal and a special or dedicated die presses the ring core metal to form waves thereon.

Next described referring to FIG. 2*a*, FIG. 2*b* and FIG. 2*c* are details of the main punch and the counter punch of the wave-processing die used for the wave-processing method according to the first embodiment. The following description is made with respect only to a part of the wave-processing die corresponding to the special die without depicting a part corresponding to the stamping-out die.

As shown in FIG. 2*a*, a special die 10 has a main punch 11 and a counter punch 12. Each of the main punch 11 and the counter punch 12 has a waved shape formed thereon. Though the waves are illustrated in an exaggerated form in FIG. 2*a*, a height of each of the waves is very small such as 0.2 mm. All top portions 13 of the waves have micro-protrusions 14 provided thereon, respectively. A height of each of the micro-protrusions 14 is 40 $\mu$m. A width of each of the micro-protrusions 14 is 200 $\mu$m.

As shown in FIG. 2*b*, the micro-protrusion 14 has a straight-line shape. Three micro-protrusions 14 are formed substantially in parallel with each other on one carving or notching section of the main punch 11. The main punch 11 has seven notching sections in total substantially at an equal angle. As shown in FIG. 2*c*, the counter punch 12 has seven notching sections in total substantially at an equal angle, too. However, the positions of the micro-protrusions 14 of the counter punch 12 are shifted from the positions of the micro-protrusions 14 of the main punch 11 so that they are alternately placed.

Next described referring to FIG. 3*a*, FIG. 3*b* and FIG. 3*c* is a step of carving or cutting notches on the ring-shaped core metal that was made by stamping or punching out the steel coil along the inner and the outer circumferences, while giving the wave shape thereto. As shown in FIG. 3*a*, the ring core metal 8 is pressed and compressed between the main punch 11 and the counter punch 12. At this time, waves are formed on the core metal 8 while the three micro-protrusions 14 provided on each of the top portions of the waves cut into the core metal 8, respectively. Then, as shown in FIG. 3*b*, three notches 15 are punched on the core metal 8 corresponding to the micro-protrusions 14. When the core metal 8 is further pressed and compressed between the main punch 11 and the counter punch 12, there takes place plastic flow at a surface layer of the core metal 8 as shown by arrows in FIG. 3*b* due to local compression by the notches 15. Thus, the waves are formed on the core metal 8 while the notches 15 define tops of the waves, respectively.

Then, as shown in FIG. 3*c*, three notches 15 are punched and formed respectively on a front surface of the core metal 8 at seven sections substantially at an equal angle. Moreover, three notches 15 are punched and formed respectively on a rear surface of the core metal 8 at seven sections near the middle of the seven sections of the front surface of the core metal 8. Thus, seven waves are formed on the core metal as a whole. The "return" phenomenon as seen in the conventional cool working method does not occur to these waves since the notches 15 are punched on the front and the rear surfaces of the core metal 8. Consequently, the waves are formed with a high degree of accuracy or at high precision on the core metal 8. The core metal 8 has a gear-shaped inner circumferential hole 8*a* and a outer circumference 8*b* of substantially a circle shape. Thus, leading ends of the notches 15 at the inner side are cut by the inner circumferential hole 8*s* of the core metal 8.

As mentioned above, with the wave-processing method and the wave-processing die of the core metal of the wet friction material according to the first embodiment, there can be obtained stably waved core metals having high waving accuracy with simple steps and in a short process time at low costs.

Second Embodiment

Figure 4:
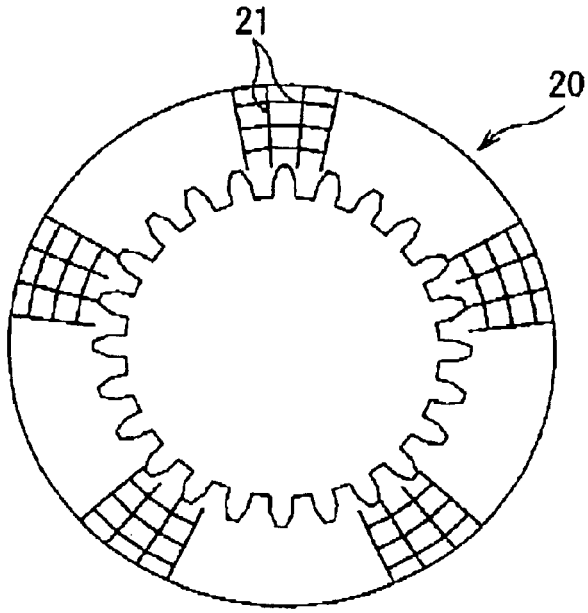
FIG. 4 is a plan view showing a waved core metal manufactured by a wave-processing method and a wave-processing die of a core metal of a wet friction material according to a second embodiment of the invention.

A wave-processing method of a core metal of a wet friction material according to a second embodiment is described referring to FIG. 4. FIG. 4 is a plan view showing a waved core metal manufactured by a wave-processing method and a wave-processing die of a core metal of a wet friction material according to a second embodiment of the invention.

As shown in FIG. 4, notches 21 are cut or carved at five sections substantially at an equal distance on a waved core metal 20 manufactured by the method according to the second embodiment. In the second embodiment, a steel material is stamped out to make a ring-shaped core metal blank by a stamping-out die. Then, the core metal blank is pressed and compressed between a main punch and a counter punch of a special die so as to punch or cut the notches 21. Notches are cut at five sections on a rear surface near the middle between the five sections of the notches 21 on the front surface of the core metal 20. Thus, the core metal 20 has five waves in total. Each of the five sections of the notches 21 is composed of four straight-lines extending in a radial direction and three lines extending in a circumferential direction of the core metal 20. Accordingly, micro-protrusions each having a shape corresponding to the notch 21 are provided at a portion corresponding to a top of each wave of the main punch and the counter punch of the special die used in the second embodiment. Since the notches 21 are formed along the circumferential direction of the core metal 20, waviness of the core metal 20 as a whole can be advantageously controlled or restrained.

Third Embodiment

Figure 5:
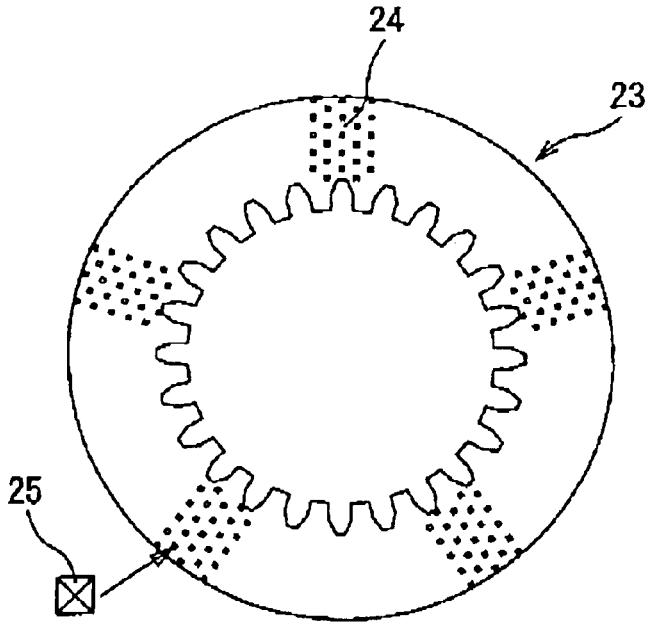
FIG. 5 is a plan view showing a waved core metal manufactured by a wave-processing method and a wave-processing die of a core metal of a wet friction material according to a third embodiment of the invention.

A wave-processing method of a core metal of a wet friction material according to a third embodiment is described referring to FIG. 5. FIG. 5 is a plan view showing a waved core metal manufactured by a wave-processing method and a wave-processing die of a core metal of a wet friction material according to a third embodiment of the invention.

As shown in FIG. 5, notches 24 are cut or carved at five sections substantially at an equal distance on a waved core metal 23 manufactured by the method according to the third embodiment. Notches are cut at five sections on a rear surface near the middle between the five sections of the notches 24 on the front surface of the core metal 23. Thus, the core metal 23 has five waves in total. Each of the five sections of the notches 23 is not composed of lines such as the first or the second embodiments but of a flock of dots 25 of a quadrangular pyramid shape. Accordingly, micro-protrusions each having a shape corresponding to the notch 23 are provided at a portion corresponding to a top of a wave of a main punch and a counter punch of a special die used in the third embodiment. Namely, each group of the micro-protrusions is composed of a flock of micro-pyramid protrusions. Since the notches 23 are formed along the circumferential direction of the core metal 20, waviness of the core metal 20 as a whole can be advantageously controlled or restrained.

Fourth Embodiment

Figure 6:
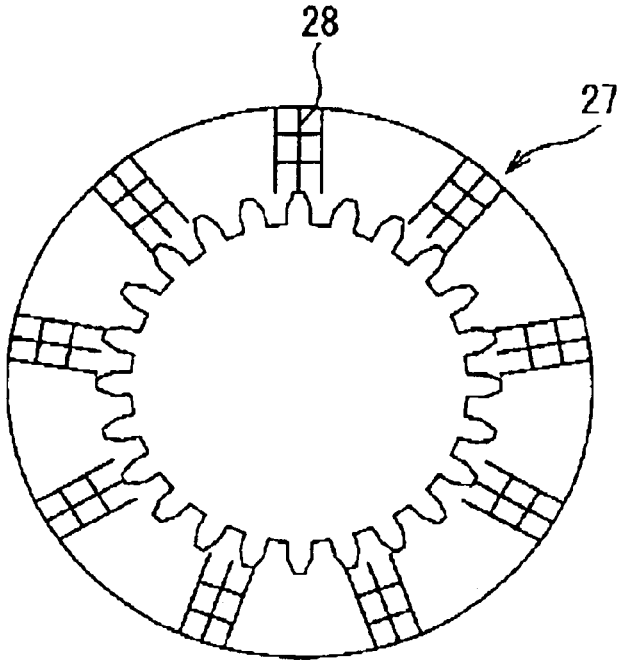
FIG. 6 is a plan view showing a waved core metal manufactured by a wave-processing method and a wave-processing die of a core metal of a wet friction material according to a fourth embodiment of the invention.

A wave-processing method of a core metal of a wet friction material according to a fourth embodiment is described referring to FIG. 6. FIG. 6 is a plan view showing a waved core metal manufactured by a wave-processing method and a wave-processing die of a core metal of a wet friction material according to a fourth embodiment of the invention.

As shown in FIG. 6, notches 28 are cut or carved at nine sections substantially at an equal angle on a waved core metal 27 manufactured by the method according to the fourth embodiment. Notches are cut at nine sections on a rear surface near the middle between the nine sections of the notches 28 on the front surface of the core metal 27. Thus, the core metal 27 has nine waves in total. Each of the nine sections of the notches 28 is composed of three parallel straight-lines such as the first embodiment and two parallel straight-lines that cross the three straight lines substantially at right angles, respectively. Accordingly, micro-protrusions each having a shape corresponding to the notch 28 are provided at a portion corresponding to a top of a wave of a main punch and a counter punch of a special die used in the fourth embodiment.

Fifth Embodiment

Figure 7:
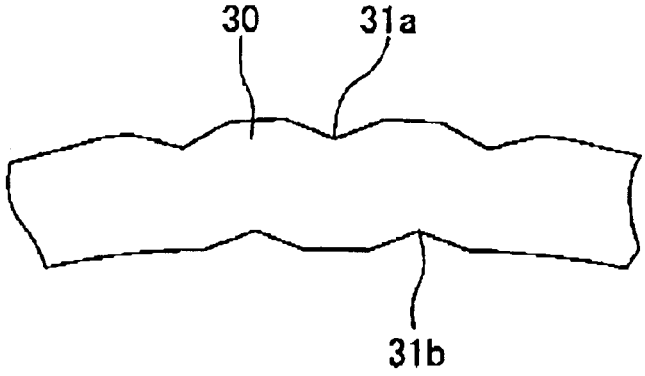
FIG. 7 is a partial side view showing a waved core metal manufactured by a wave-processing method and a wave-processing die of a core metal of a wet friction material according to a fifth embodiment of the invention.
Figure 8:
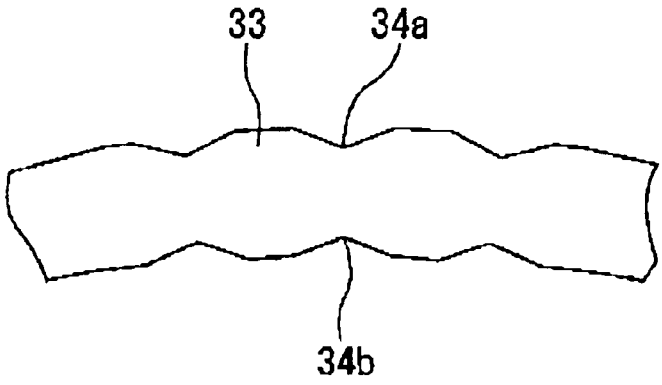
FIG. 8 is a partial side view showing a waved core metal that has notches formed at undesirable positions on its front and rear surfaces.

A wave-processing method of a core metal of a wet friction material according to a fifth embodiment is described referring to FIG. 7 and FIG. 8. FIG. 7 is a partial side view showing a waved core metal manufactured by a wave-processing method and a wave-processing die of a core metal of a wet friction material according to a fifth embodiment of the invention. FIG. 8 is a partial side view showing a waved core metal that has notches formed at undesirable positions on its front and rear surfaces.

As shown in FIG. 7, notches 31*a* of a wedge cross section and notches 31*b* of a wedge cross section are provided alternately or one by one on a front surface and a rear surface of a ring-shaped core metal 30. The notches 31*a* at the front surface are shifted in positions from the notches 31*b* at the rear surface. Thus, there is no strength reduction of the core metal problem and there arise no troubles. However, if notches 34*a* and 34*b* are located at the same positions on a front surface and a rear surface of a core metal 33 as shown in FIG. 8, strength of the core metal 33 is lowered very much. Therefore, such positioning should be avoided.

Sixth Embodiment

Figure 9:
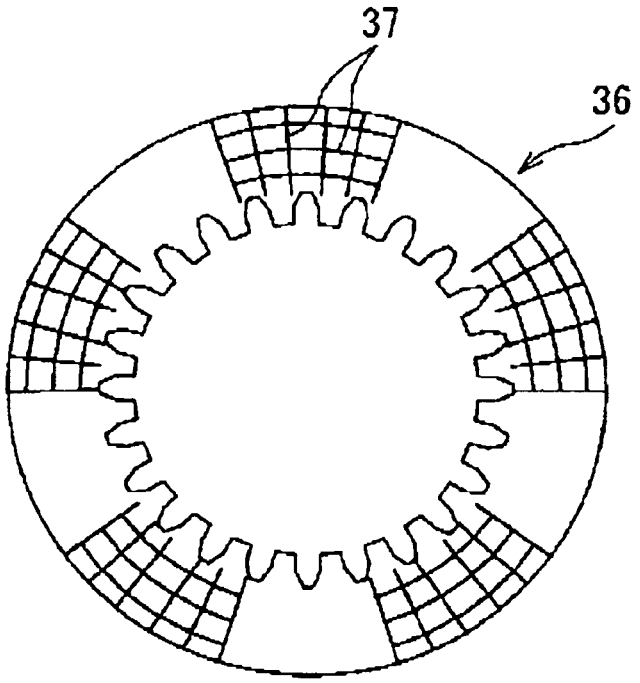
FIG. 9 is a plan view showing a waved core metal manufactured by a wave-processing method and a wave-processing die of a core metal of a wet friction material according to a sixth embodiment of the invention.

A wave-processing method of a core metal of a wet friction material according to a sixth embodiment is described referring to FIG. 9. FIG. 9 is a plan view showing a waved core metal manufactured by a wave-processing method and a wave-processing die of a core metal of a wet friction material according to a sixth embodiment of the invention.

As shown in FIG. 9, notches 37 are cut or carved at five sections substantially at an equal distance on a waved core metal 36 in the sixth embodiment as in the second embodiment. In the sixth embodiment, each of the five sections of the notches 36 is composed of radially extending five straight-lines and circumferentially extending three curved lines. The radially extending straight-lines are disposed at constant intervals or at an equal distance with each other at one section in the second embodiment. On the other hand, the radially extending straight-lines are disposed at uneven intervals with each other at one section in the circumferential direction of the core metal 36 in the sixth embodiment. The circumferentially extending curved lines may be disposed at constant intervals or uneven intervals vice versa with each other in the radial direction of the core metal in the second embodiment and the sixth embodiment.

In the same way, though the interval between the notch lines are usually constant in the first and the fourth embodiments, it may be uneven in some cases. Moreover, in the third embodiment, the dots 25 may be aligned in the radial direction of the core metal 23 so as to define several radially extending dotted lines as the notches 24. However, the dots 25 may not be aligned but disposed at random within an area of the section of the notches 24.

Seventh Embodiment

Figure 10:
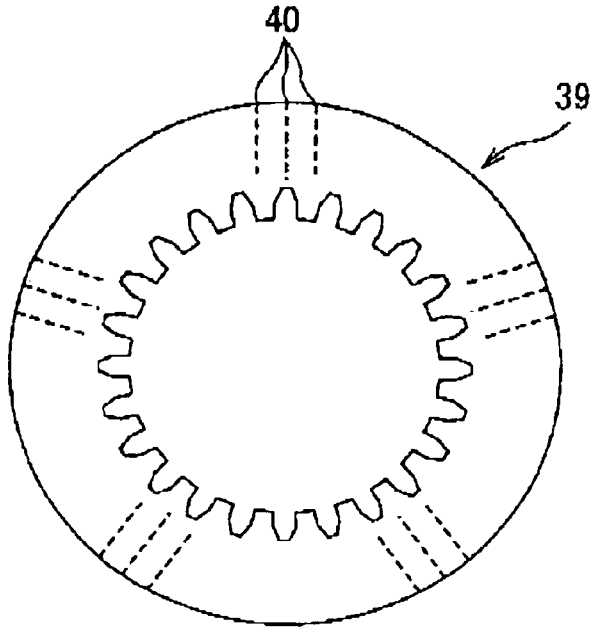
FIG. 10 is a plan view showing a waved core metal manufactured by a wave-processing method and a wave-processing die of a core metal of a wet friction material according to a seventh embodiment of the invention.

A wave-processing method of a core metal of a wet friction material according to a seventh embodiment is described referring to FIG. 10. FIG. 10 is a plan view showing a waved core metal manufactured by a wave-processing method and a wave-processing die of a core metal of a wet friction material according to a seventh embodiment of the invention.

As shown in FIG. 10, three dashed lines of notches 40 are cut or carved at five sections substantially at an equal angle on a waved core metal 39 in the seventh embodiment. The radially extending dashed-lines of the notches 40 are disposed at constant intervals or at an equal distance with each other at one section. However, the notches 40 may be disposed at uneven intervals in some cases.

That is, as described in the sixth and the seventh embodiments, the pattern and the number of the notches may be selected as desired depending on a required wave height and wave accuracy in practicing the invention.

Eighth Embodiment

Figure 11:
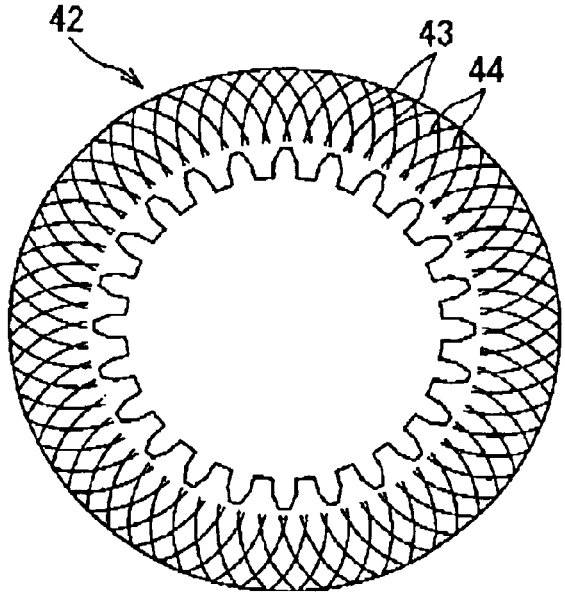
FIG. 11 is a plan view showing a waved core metal manufactured by a wave-processing method and a wave-processing die of a core metal of a wet friction material according to a eighth embodiment of the invention.

A wave-processing method of a core metal of a wet friction material according to an eighth embodiment is described referring to FIG. 11. FIG. 11 is a plan view showing a waved core metal manufactured by a wave-processing method and a wave-processing die of a core metal of a wet friction material according to a eighth embodiment of the invention.

As shown in FIG. 11, many notches 43 of a gentle curve are cut or carved at small intervals over an entire front surface of a waved core metal 42. Many notches 44 of a gentle curve that is directed oppositely to the curve of the notch 43 are cut or carved at the same intervals over the entire front surface of the core metal 42, too. Thus, a net-like pattern is formed on the front surface of the core metal 42 as a whole. Moreover, though not shown, many notches of the same shape are cut or carved on an entire rear surface of the core metal 42 at middle positions between the adjacent notches 43 and 43 on the front surface of the core metal 42. Thus, a net-like pattern is formed on the rear surface of the core metal 42 as a whole, too. Then, five, waves are formed on the ring-shaped core metal 42 at predetermined sections such as five, seven or nine sections in total.

A material (steel plate) of the core metal may have a poor flatness before forming waves thereon. That is, the steel plate may be not wholly flat but a little warped or may have slight irregularity over its entire plane. Then, even if the core metal is pressed and compressed by the wave-processing die having the fixed waving surface and the micro-protrusions described above, a designed wave height may not be obtained in some cases. Namely, if the core metal material (steel plate) has poor flatness before forming waves, it is impossible to stably obtain high waving accuracy.

In view of the above facts, the eighth embodiment punches the notches 43 and 44 on the entire front surface and the entire rear surface of the core metal 42 before forming the waves. Then, a pressure can be applied to the whole material (steel plate) of the core metal 42 so as to correct the flatness. Thus, a completely flat material (steel plate) of the core metal 42 can be pressed and compressed by the wave-processing die. Consequently, it is possible to stably obtain high waving accuracy. In addition, the pressure is applied to the entirety of the core metal, so that it is possible to prevent the "return" phenomenon at the time of waving work. Therefore, it is unnecessary to provide the micro-protrusions at a portion corresponding to the top of the wave of the wave-processing die that is used for waving work of the core metal 42. As described above, the core metal 42 can have high waving accuracy.

In manufacturing the waved core metal, the notches 43 and 44 are punched on the entire front surface and the entire rear surface of the material of the core metal 42 first. Then, the material is stamped out at the inner and the outer circumference of the core metal 42, while the material is simultaneously added with the waving form so as to give waves to the core metal 42. Alternately, the notches 43 and 44 are punched on the entire front surface and the entire rear surface of the material of the core metal 42 first. Next, the material is stamped out at the inner and the outer circumference of the core metal 42. Thereafter, the material is added with the waving form by the wave-processing die.

Ninth Embodiment

Figure 12:
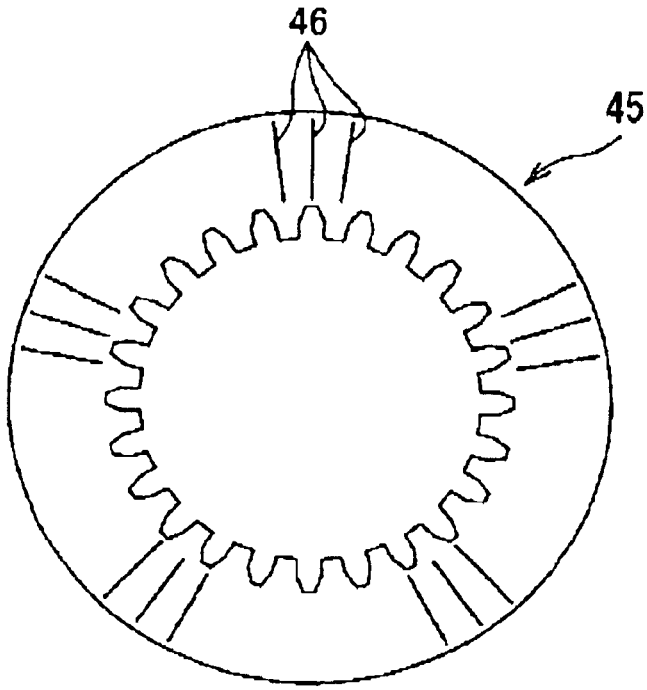
FIG. 12 is a plan view showing a waved core metal manufactured by a wave-processing method and a wave-processing die of a core metal of a wet friction material according to a ninth embodiment of the invention.
Figure 13:
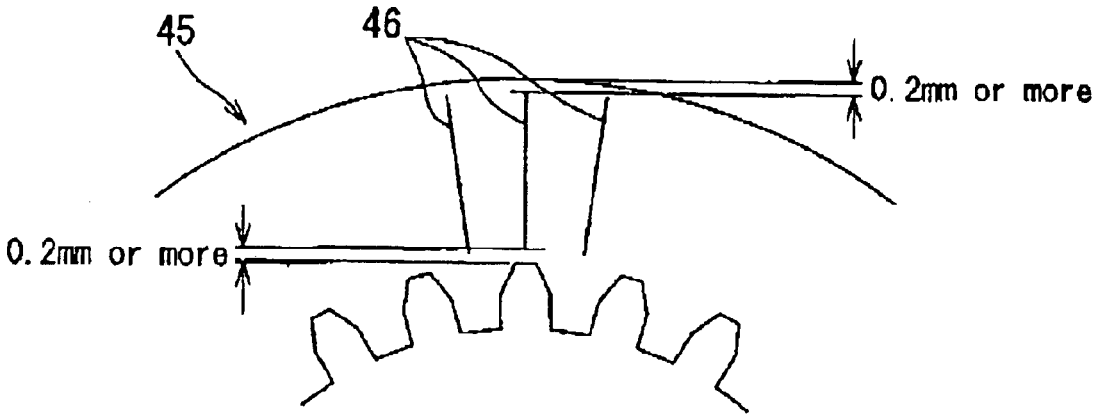
FIG. 13 is a enlarged view showing a notched portion of the waved core metal according to a ninth embodiment of the invention.
Figure 14:
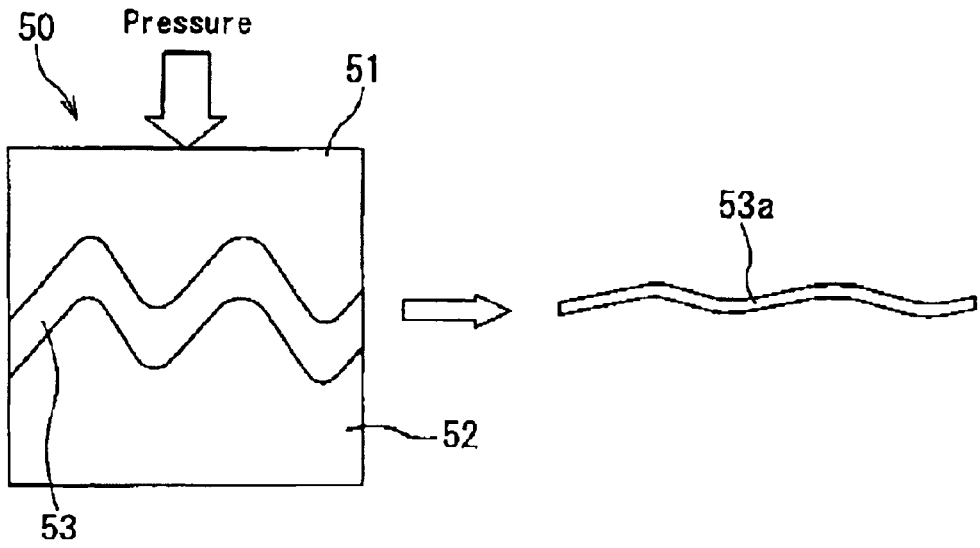
FIG. 14 is a schematic view showing a conventional cool working method.
Figure 15:
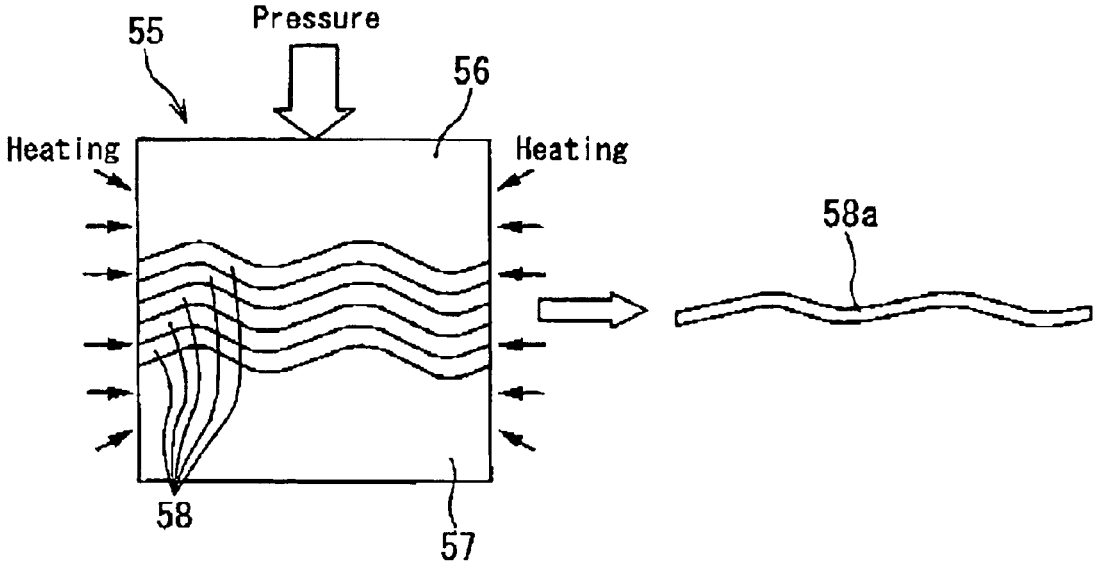
FIG. 15 is a schematic view showing a conventional hot working method.

A wave-processing method of a core metal of a wet friction material according to a ninth embodiment is described referring to FIG. 12 and FIG. 13. FIG. 12 is a plan view showing a waved core metal manufactured by a wave-processing method and a wave-processing die of a core metal of a wet friction material according to a ninth embodiment of the invention. FIG. 13 is a enlarged view showing a notched portion of the waved core metal according to a ninth embodiment of the invention.

In each of the above first to the eighth embodiments, as shown in FIG. 3 to FIG. 11, the radially or substantially radially extending notches are punched on the core metal so as to reach the outer circumference of the core metal.

Moreover, part of the notches reach the inner circumference of the core metal. There is no problem at all when the core metal is used under normal load. However, if the core metal is used under severe conditions such as a high speed operation or harsh pressure repetition, the notches reaching the outer or inner circumference of the core metal may become a start point of a crack, thereby lowering the strength of the core metal.

Therefore, as shown in FIG. 12 and FIG. 13, the waving work is carried out such that leading ends of punched notches 46 do not reach an outer circumference or an inner circumference of a core metal 45. Thus, the core metal is prevented from lowering its strength even it is used particularly under high load condition. Specifically, as shown in FIG. 13, the waving work is carried out such that the leading ends of the notches 46 get 0.2 mm or more away from the outer and the inner circumferences of the core metal 45, respectively. Consequently, the core metal 45 is prevented from lowering the strength and can sufficiently endure a use under the high load condition.

Table 1 shows characteristic features and variation of heights of the waves from designed values in each of the first to the fifth embodiment. Table 1 also shows data of the conventional cool working method that has no notches punched thereon as a comparison example.

TABLE 1

| | Processing Method | Notch Shape | Wave Number | Designed Wave Height | Height Variation |
|---|---|---|---|---|---|
| First Embodiment | Simultaneous Stamping & Waving | FIG. 3 | 7 | 0.20 mm | 0.05 mm |
| Second Embodiment | Separate Waving | FIG. 4 | 5 | 0.25 mm | 0.06 mm |
| Third Embodiment | Simultaneous Stamping & Waving | FIG. 5 | 5 | 0.25 mm | 0.04 mm |
| Fourth Embodiment | Simultaneous Stamping & Waving | FIG. 6 | 9 | 0.30 mm | 0.04 mm |
| Fifth Embodiment | Simultaneous Stamping & Waving | FIG. 7 | 7 | 0.20 mm | 0.03 mm |
| Comparison Example | Separate Waving | N/A | 7 | 0.20 mm | 0.19 mm |

As shown in Table 1, according to the processing method or the manufacturing method in the second embodiment and the comparison example, the material sheet is stamped out into the ring core metal first, then the waving work is applied to the core metal. According to the processing methods in all the other embodiments, the waving work is carried out simultaneously with the stamping out of the material sheet into the ring core metal.

As shown in each of FIG. 3 to FIG. 7, as regards the notch shape, the first embodiment has three generally parallel straight lines. The second embodiment has four radially extending straight lines and three circumferentially extending lines crossing these straight lines. The third embodiment has an aggregate of micro-pyramid dots. The fourth embodiment has three generally parallel straight lines and two generally parallel straight lines that cross the three straight lines generally at right angles. The fifth embodiment has one straight line.

The number of waves is seven in the first embodiment, five in the second embodiment, five in the third embodiment, nine in the fourth embodiment, seven in the fifth embodiment and seven in the comparison example.

The variation of the waving height is 0.05 mm for the designed waving height of 0.20 mm in the first embodiment. The variation of the waving height is 0.06 mm for the designed waving height of 0.25 mm in the second embodiment. The variation of the waving height is 0.04 mm for the designed waving height of 0.25 mm in the third embodiment. The variation of the waving height is 0.04 mm for the designed waving height of 0.30 mm in the fourth embodiment. The variation of the waving height is 0.03 mm for the designed waving height of 0.20 mm in the first embodiment. Thus, the variation is kept small in each of the first to the fifth embodiments. The variation is particularly small in the fourth and the fifth embodiments. In contrast, the variation of the waving height is 0.19 mm for the designed waving height of 0.20 mm in the comparison example. Namely, the variation is substantially the same as the designed waving height. Thus, it is understood that the comparison example is off from practical use.

In the wave-processing methods according to each of the above embodiments, the core metal is compressed between the main punch and the counter punch at the same time as or after the material steel sheet is stamped out into the core metal. Therefore, the process is very simple and the processing time is very short as compared with the conventional hot working method. Moreover, the inventive method needs no hot heating, thereby decreasing the production costs. Furthermore, the curved portion with the notched portion as the top generates no "return" phenomenon, so that the high waving accuracy is obtained as shown in Table 1.

As described above, according to the inventive wave-processing method and wave-processing die of the core metal of the wet friction material, high waving accuracy is stably obtained with a simple process, in short time and at low costs.

The invention is not limited to the above embodiments with respect to the other steps of the wave-processing method of the core metal of the wet friction material as well as a structure, shape, number, material, dimension, relation of connection, etc. of the other parts of the wave-processing die.

Advatageous Effects

As described above, according to the inventive wave-processing method and the inventive wave-processing die, when the core metal is pressed and compressed from upward and downward, plastic flow is generated at a superficial layer of the core metal due to partial compression by the notches formed by the micro-protrusions. Then, the curve or the wave is formed while the notched portion becomes the top of the wave. Accordingly, if the micro-protrusions are provided on the main punch and the counter punch depending on a required number and a required height of the waves so as to cut the notches on the tops of the waves of the core metal, the wave shape can be easily and stably processed on the core metal.

According to the wave-processing method and the inventive wave-processing die, the core metal is compressed between the main punch and the counter punch at the same time as or after stamping out the material steel sheet to form the core metal. Consequently, the process is much simpler and the processing time is much shorter than the conventional hot working process. Moreover, since the inventive method does not need heating at a high temperature, the costs can be decreased. Furthermore, the curved portion with the notched portion as the top point does not generate the "return" phenomenon, so that high waving accuracy can be obtained. The shape of the micro-protrusion for cutting the notch may be a lined shape or a dotted shape. The number of the micro-protrusions may be selected as desired according to the required wave height and wave accuracy.

As described above, according to the inventive wave-processing method and the inventive wave-processing die for the core metal of the wet friction material, high waving accuracy can be stably obtained with a simple process, in a short processing time and at low costs.

According to the inventive wave-processing die, the core metal is compressed by the main punch and the counter punch, so that the height of the micro-protrusion provided on the main punch and the counter punch equals the depth of the notch cut in the core metal as it is, while the width of the micro-protrusion equals the width of the notch as it is. Then, if the depth and the width of the notch is too small, sufficient wave-processing effects cannot be obtained. To the contrary, if the depth and the width of the notch is too large, the strength of the core metal may be lowered. Then, if the micro-protrusion has a height of about 1% to 5% of a thickness of the core metal and a width of about 50 $\mu$m to 500 $\mu$m, the notch of appropriate depth and width can be formed. Consequently, it is possible to carry out wave-processing of high accuracy.

According to the inventive wave-processing die, the waves are given in the circumferential direction of the core metal. Then, the linear micro-protrusions extending in the radial direction need to be provided in order to generate the plastic flow of the surface layer of the core metal in the circumferential direction due to the partial compression by the notches. However, it is possible to restrain waviness of the core metal as a whole by cutting the notches extending in the circumferential direction of the core metal. Then, if the micro-protrusion has a shape composed of a plurality of first lines extending straightly in a radial direction of the core and a plurality of second lines extending straightly or curvedly substantially in a circumferential direction of the core metal while crossing the first lines, it is possible to carry out wave-processing of much higher accuracy.

According to the inventive wave-processing die, if the notches formed on the core metal reach the inner circumference or the outer circumference of the core metal, there is no trouble in use under normal load. However, if the core metal is used under severe conditions such as a use at high speed or harsh pressure repetition, the notches may become start points of the cracks so as to lower the strength of the core metal may be lowered. Then, in case of use under high load condition, if the micro-protrusion has a length such that opposite ends of the notch formed on the core metal by the micro-protrusion are positioned 0.2 mm or more away from the outer and the inner circumferences of the core metal, the core metal is prevented from lowering its strength. Thus, according to the inventive wave-processing, the core metal can be used even under high load condition.

According to the inventive wave-processing method, the material steel sheet for the core metal may have poor flatness before giving the waves. That is, the steel sheet may be not completely flat but a little warped or may have slight irregularity as a whole. Then, even if the core metal is compressed by the wave-processing die having a predetermined wave face and micro-protrusions, the height of the wave may not be a designed value. Thus, if the steel sheet for the core metal may have poor flatness before giving the waves, it is impossible to stably obtain high waving accuracy.

Therefore, the notches of net shape are cut on the entire front surface and the entire rear surface of the core metal before giving the waves, so that the material steel sheet of the core metal is applied with pressure. Consequently, the steel sheet of the core metal can have a complete flatness before being pressed and compressed by the wave-processing die. As a result, it is possible to stably obtain high waving accuracy. In addition, the pressure is applied to the entire core metal, so that the "return" phenomenon can be prevented at the time of wave-processing. Accordingly, there is no need to provide micro-protrusions at the portion corresponding to the top points of the waves on the wave-processing die that is used for the wave-processing of the core metal. Thus, high accuracy of waving can be obtained on the core metal.

The inventive wave-processing die according to the eighth embodiment is composed of the first processing die and the second processing die. Then, the material steel sheet is compressed by the second processing die so that the micro-protrusions are cut in the material steel sheet so as to form the notches of net shape composed of many curves. Thus, the flatness of the material steel sheet is corrected. Moreover, the "return" phenomenon is prevented at the time of wave-processing by applying pressure to the entire portion to be the core metal of the material steel sheet. Consequently, the first processing die needs not to be provided with the micro-protrusions at the top point of the wave shape but is enough to be provided with the wave shape. Even in this case, when the core metal is compressed by the first processing die, high waving accuracy can be obtained.

The preferred embodiments described herein are illustrative and not restrictive, the scope of the invention being indicated in the appended claims and all variations which come within the meaning of the claims are intended to be embraced therein.

What is claimed is:

1. A wave-processing method for a core metal of a wet friction material comprising the steps of stamping out a material steel sheet so as to form a core metal blank having a shape corresponding to a shape of the core metal by a stamping die, and giving a wave shape to the core metal blank in a circumferential direction thereof by a special die at the same time as or after the stamping step;

wherein the special die has a main punch as an upper die and a counter punch as a lower die, the main punch and the counter punch have compression faces respectively formed with the wave shape while having a micro-protrusion at a portion corresponding to a top point of the wave shape; and wherein the core metal blank is compressed between the main punch and the counter punch so that the micro-protrusion is cut into the core metal blank so as to form a notch on the core metal blank.

2. A wave-processing method for a core metal of a wet friction material comprising the steps of:

compressing a material steel sheet by a die having micro-protrusions on an entire surface so as to form notches of a net shape composed of many curves at a front surface and a rear surface of a portion to be the core metal of the material steel sheet, thereby correcting a flatness of the material steel sheet at the portion:

stamping out the material steel sheet after the compressing step so as to form a core metal blank having a shape corresponding to a shape of the core metal by a stamping die; and giving a wave shape to the core metal blank in a circumferential direction thereof by a special die at the same time as or after the stamping step;

wherein the special die has a main punch and a counter punch, the main punch and the counter punch have compression faces respectively formed with the wave shape; and wherein the core metal blank is compressed between the main punch and the counter punch.

3. A wave-processing die for a core metal of a wet friction material for stamping out a material steel sheet so as to form a core metal blank having a shape corresponding to a shape of the core metal, and giving a wave shape to the core metal blank in a circumferential direction thereof at the same time as or after stamping, comprising:

a main punch having a compression face; and a counter punch having a compression face oppositely disposed to the compression face of the main punch;

the compression faces of the main punch and the counter punch being respectively formed with the wave shape while having a micro-protrusion at a portion corresponding to a top point of the wave shape;

wherein the core metal blank is compressed between the main punch and the counter punch so that the micro-protrusion is cut into the core metal blank so as to form a notch on the core metal blank.

4. A wave-processing die for a core metal of a wet friction material according to claim 3, in which the micro-protrusion has a height of about 1% to 5% of a thickness of the core metal and a width of about 50 $\mu$m to 500 $\mu$m.

5. A wave-processing die for a core metal of a wet friction material according to claim 3, in which the micro-protrusion has a shape composed of a plurality of first lines extending straightly in a radial direction of the core and a plurality of second lines extending straightly or curvedly substantially in a circumferential direction of the core metal while crossing the first lines.

6. A wave-processing die for a core metal of a wet friction material according to claim 3, in which the micro-protrusion has a shape composed of an aggregate of dots having a pyramid-shape.

7. A wave-processing die for a core metal of a wet friction material according to claim 3, in which the micro-protrusion has a cross-section of a wedge and the micro-protrusion of the main punch is shifted in position from the micro-protrusion of the counter punch in a circumferential direction of the core metal.

8. A wave-processing die for a core metal of a wet friction material according to claim 3, in which the micro-protrusion has a shape of a broken line.

9. A wave-processing die for a core metal of a wet friction material according to claim 3, in which the micro-protrusion has a length such that opposite ends of the notch formed on the core metal by the micro-protrusion are positioned 0.2 mm or more away from outer and inner circumferences of the core metal.

10. A wave-processing die for a core metal of a wet friction material comprising:

a first processing die for stamping out a material steel sheet so as to form a core metal blank having a shape corresponding to a shape of the core metal and for giving a wave shape to the core metal blank in a circumferential direction thereof at the same time as or after stamping;

the first processing die having a main punch and a counter punch respectively having compression faces disposed opposite to each other and being respectively formed with the wave shape;

a second processing die for correcting a flatness of the material steel sheet; and the second processing die having a main punch and a counter punch respectively having compression faces disposed opposite to each other and being respectively formed with micro-protrusions for forming a net shape composed of many curves;

wherein the core metal blank is compressed between the main punch and the counter punch of the first processing die so as to give the wave shape to the core metal blank after the material steel sheet is compressed between the main punch and the counter punch of the second processing die so that the micro-protrusions are cut into the core metal blank so as to form notches of the net shape composed of the many curves on the core metal blank.

* * * * *